US009825356B2

(12) United States Patent
Wagner et al.

(10) Patent No.: US 9,825,356 B2
(45) Date of Patent: Nov. 21, 2017

(54) ELASTOMERIC AND FLEXIBLE CABLES

(71) Applicant: Minnesota Wire and Cable, St. Paul, MN (US)

(72) Inventors: Paul J. Wagner, Eagan, MN (US); Eric J. Wagner, Mendota Heights, MN (US); Chris Duca, Cape Coral, FL (US); Jeffrey C. Lewison, Shoreline, MN (US); Kevin Voigt, St. Paul, MN (US); Thomas R. Kukowski, Apple Valley, MN (US)

(73) Assignee: Minnesota Wire and Cable, St. Paul, MN (US)

( * ) Notice: Subject to any disclaimer, the term of this patent is extended or adjusted under 35 U.S.C. 154(b) by 332 days.

(21) Appl. No.: 14/642,395

(22) Filed: Mar. 9, 2015

(65) Prior Publication Data

US 2015/0257315 A1 Sep. 10, 2015

Related U.S. Application Data

(60) Provisional application No. 61/950,131, filed on Mar. 9, 2014, provisional application No. 62/057,547, filed on Sep. 30, 2014, provisional application No. 62/117,240, filed on Feb. 17, 2015.

(51) Int. Cl.

| | |
|---|---|
| ***H01Q 1/38*** | (2006.01) |
| ***H01B 3/18*** | (2006.01) |
| ***H01B 7/06*** | (2006.01) |
| ***H01Q 1/40*** | (2006.01) |
| ***H01Q 1/46*** | (2006.01) |
| ***H01B 3/28*** | (2006.01) |
| ***H04R 1/10*** | (2006.01) |

(52) U.S. Cl.

CPC ..... *H01Q 1/38* (2013.01); *H01B 3/18* (2013.01); *H01B 3/28* (2013.01); *H01B 7/06* (2013.01); *H01Q 1/40* (2013.01); *H01Q 1/46* (2013.01); *H04R 1/1033* (2013.01)

(58) Field of Classification Search

CPC ... H01Q 1/38; H01Q 1/40; H01Q 1/46; H04R 1/1033; H01B 3/18; H01B 3/28; H01B 7/06

USPC ..... 343/897

See application file for complete search history.

(56) References Cited

U.S. PATENT DOCUMENTS 5,973,645 A * 10/1999 Zigler ..... H01Q 1/241 343/702
6,005,524 A * 12/1999 Hayes ..... H01Q 1/40 343/702
9,605,363 B2 * 3/2017 Zhang ..... B32B 18/00

* cited by examiner

*Primary Examiner* — Lam T Mai
(74) *Attorney, Agent, or Firm* — Duft Bornsen & Fettig LLP; Gregory T. Fettig

(57) ABSTRACT

Systems and methods presented herein provide for elastomeric and flexible cables. One cable includes a first insulator extruded as a tube. The cable also includes an elastomeric conductor comprising conductive particles embedded in a polymer. The elastomeric conductor is extruded with the elastomeric insulator through a conduit of the tube. Other cables include flexible wires extruded with elastomeric tubes. In some embodiments, the cables are configured with stay cords that limit a length of stretching in the cable.

17 Claims, 9 Drawing Sheets

ELASTOMERIC AND FLEXIBLE CABLES

CROSS REFERENCE TO RELATED APPLICATIONS

This patent application claims priority to and thus the benefit of an earlier filing date from U.S. Provisional Patent Application Nos. 61/950,131 (filed Mar. 9, 2014), 62/057,547 (filed Sep. 30, 2014), and 62/117,240 (filed Feb. 17, 2015), the contents of each of which are hereby incorporated by reference.

BACKGROUND

Wire and cable are ubiquitous. They exist in buildings, vehicles, electronic devices, appliances, utilities, agriculture, construction, etc. While in many instances flexible, wire and cable generally do not stretch. In construction, hidden wires and cables can create problems when upgrades and repairs are needed. For example, cables can be subjected to great stress and even broken during extractions for repairs.

In the wearable electronics industry, cable manufacturers configure malleable cables using stainless steel wire or other rigid materials laid alongside insulated conductors. The combination is then encased in a heat shrink material. But, this generally results in an unsightly configuration that prevents the overall cable from being fully malleable. And, this configuration can leave a ridge in the overall cable that can result in the heat shrink material eventually wearing and fraying. Moreover, this ridge can be relatively uncomfortable when formed into a shape for a user's wearing. For example, when the cable is part of a headphone earpiece that wraps around a user's ear, the ridge can be quite uncomfortable.

SUMMARY

Systems and methods presented herein provide for elastomeric and flexible cables. In one embodiment, a cable includes a first insulator extruded as a tube. The cable also includes a flexible metal wire extruded with the elastomeric insulator through a conduit of the tube. The cable also includes at least two conductors wrapped about an external surface of the elastomeric insulator along a length of the cable so as to separate the conductors from the flexible metal wire and a second insulator surrounding the elastomeric insulator along the length of the cable.

In another embodiment, a cable includes an elastomeric insulator extruded as a tube. The cable also includes an elastomeric conductor comprising conductive particles embedded in a polymer. The elastomeric conductor is extruded with the elastomeric insulator through a conduit of the tube.

In another embodiment, a cable comprises an elastomeric core and at least two insulated conductors configured about an external surface of the elastomeric core along a length of the cable. The insulated conductors are separated from each other along the length of the cable. The separation of the insulated conductors is operable to reduce crosstalk in the cable. The cable also includes a stay cord (a.k.a. a "shock cord") configured alongside the elastomeric core. The stay cord is operable to limit extension along the length of the cable. The cable also includes an elastomeric insulator configured about the elastomeric core and covering the at least two insulated conductors and the stay cord.

The various embodiments disclosed herein may be implemented in a variety of ways as a matter of design choice. For example, some embodiments herein are implemented in hardware whereas other embodiments may include processes that are operable to implement and/or operate the hardware.

BRIEF DESCRIPTION OF THE DRAWINGS

Some embodiments of the present invention are now described, by way of example only, and with reference to the accompanying drawings. The same reference number represents the same element or the same type of element on all drawings.

DETAILED DESCRIPTION OF THE DRAWINGS

The figures and the following description illustrate specific exemplary embodiments of the invention. It will thus be appreciated that those skilled in the art will be able to devise various arrangements that, although not explicitly described or shown herein, embody the principles of the invention and are included within the scope of the invention. Furthermore, any examples described herein are intended to aid in understanding the principles of the invention and are to be construed as being without limitation to such specifically recited examples and conditions. As a result, the invention is not limited to the specific embodiments or examples described below.

Figure 1:
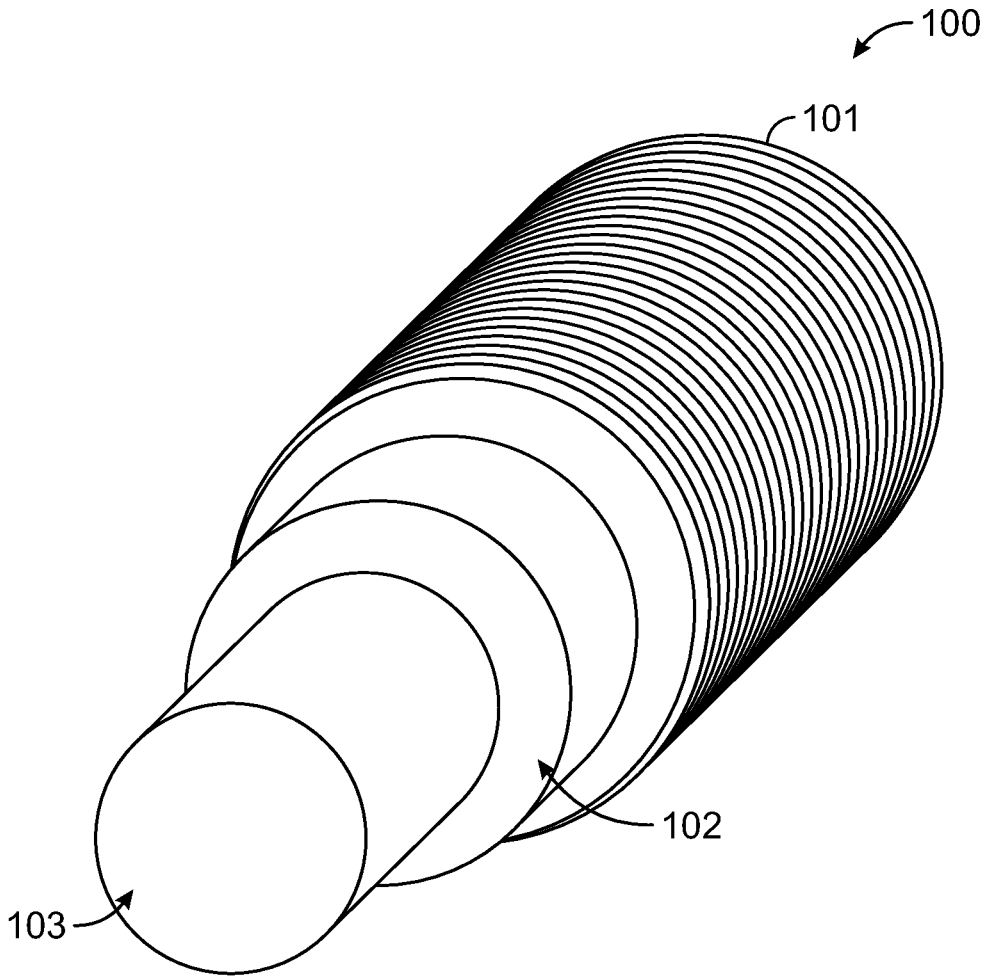
FIG. 1 is a perspective view of an exemplary elastomeric cable.

FIG. 1 is a perspective view of an exemplary elastomeric cable 100. In this embodiment, the cable 100 is configured with three layers—an elastomeric shielding 101, and elastomeric insulator 102, and elastomeric conductive core 103 (i.e., a "stretchable" conductor). The elastomeric conductive core 103 is operable to conduct electrical energy, such as data signals and other low voltage signals. The conductive core 103 is generally configured from elastomeric polymer that has been doped with conductive particles. In one embodiment, these conductive particles are nano-particulates such as carbon nanotubes. For example, while the polymer is in a molten state during the manufacturing process, carbon nanotubes may be mixed in a relatively consistent fashion. Then, the doped polymer may be extruded to provide a stretchable conductive core.

Similarly, the elastomeric insulator 102 may be configured from a polymer and extruded as a tube through which the elastomeric conductive core 103 resides. As the elastomeric insulator 102 comprises no conductive particles, the elastomeric insulator 102 insulates the conductive core 103. And, if the insulator 102 is configured from the same polymer, then the insulator 102 should have a similar elasticity making the overall cable 100 elastic.

The elastomeric shielding 101 is operable to shield the conductive core 103 from electromagnetic interference. The elastomeric shielding 101 may be configured in a variety ways as a matter of design choice. For example, in one embodiment, the elastomeric shielding 101 is configured in a manner similar to the elastomeric conductive core 103. In such an embodiment, the polymer of the shielding 101 may be embedded with carbon nanotubes or other conductive particulates. Alternatively or additionally, the shielding 101 may be configured from a metal fabric. Such an embodiment may assist in limiting the length of stretchable extension of the cable 100, thereby also operating as a sort of "stay cord" to prevent the cable 100 from breaking when stretched too far.

The manner in which the cable 100 is manufactured is not intended to be limited to any particular method. For example, each of the components 101, 102, and 103 may be extruded together at one time when using a common polymer where the doping of conductive particles occurs during the extrusion process. Alternatively, one or more of the components 101, 102, 103 may be extruded separately and inserted individually. For example, the elastomeric insulator 102 may be extruded as a tube that is laid open (e.g., slit) such that an extruded elastomeric conductive core 103 can be placed inside. In another example, an extruded elastomeric conductive core 103 can be placed in a mold such that a polymer can be injected therein to form the elastomeric insulator 102. Other exemplary embodiments are shown and described below.

Figure 2:
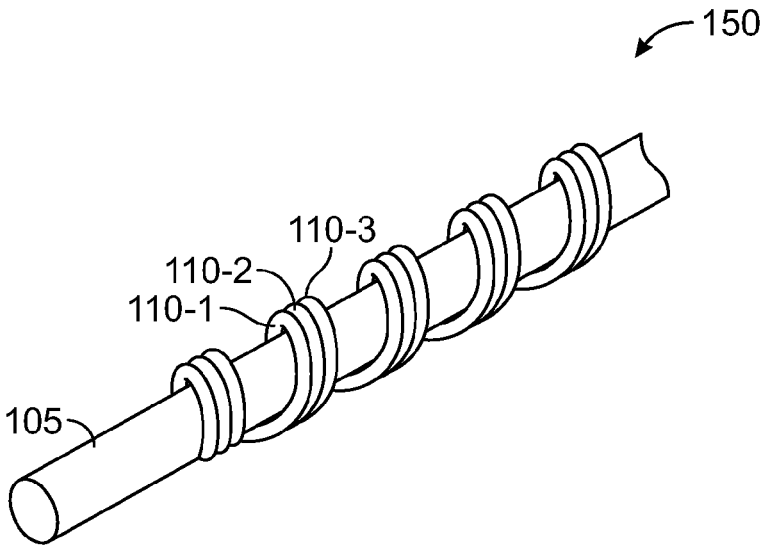
FIG. 2 is a perspective view of an exemplary elastomeric cable with conductors wrapped about an elastomeric core.

FIG. 2 is a perspective view of an exemplary elastomeric cable 150 with conductors 110-1-110-3 wrapped about an elastomeric core 105. Similar to the elastomeric conductive core 103 of FIG. 1, the elastomeric core 105 may be extruded to provide a stretchable core for the cable 150. In this embodiment, however, the elastomeric core 105 is not doped with conductive particles and is therefore more insulative in nature. Conductors 110-1-110-3 are instead wrapped about the elastomeric core 105 to provide a certain amount of extension to the cable 150. For example, the conductors 110-1-110-1 may be traditional insulated conductors that are manufactured via an extrusion process. These conductors 110 are then wrapped about the elastomeric core 105. As the elastomeric core 105 may stretch, there is generally still a limit to how far the core 105 may stretch before breaking. The conductors 110 may substantially limit the amount of extension by the core 105 before the cable 150 breaks.

In any case, the elastomeric core 105 generally compresses itself during elongation giving it a natural "stop point" with the wrapped conductors 110 adding to the compression break strength. Alternatively or additionally, the overall stretch may be limited with a spiral wrap of a strength member core with fewer twists per inch then the conductors 110. Another technique would include strengthening the cable 150 with a braided strength member over the elastic material.

Figure 3:
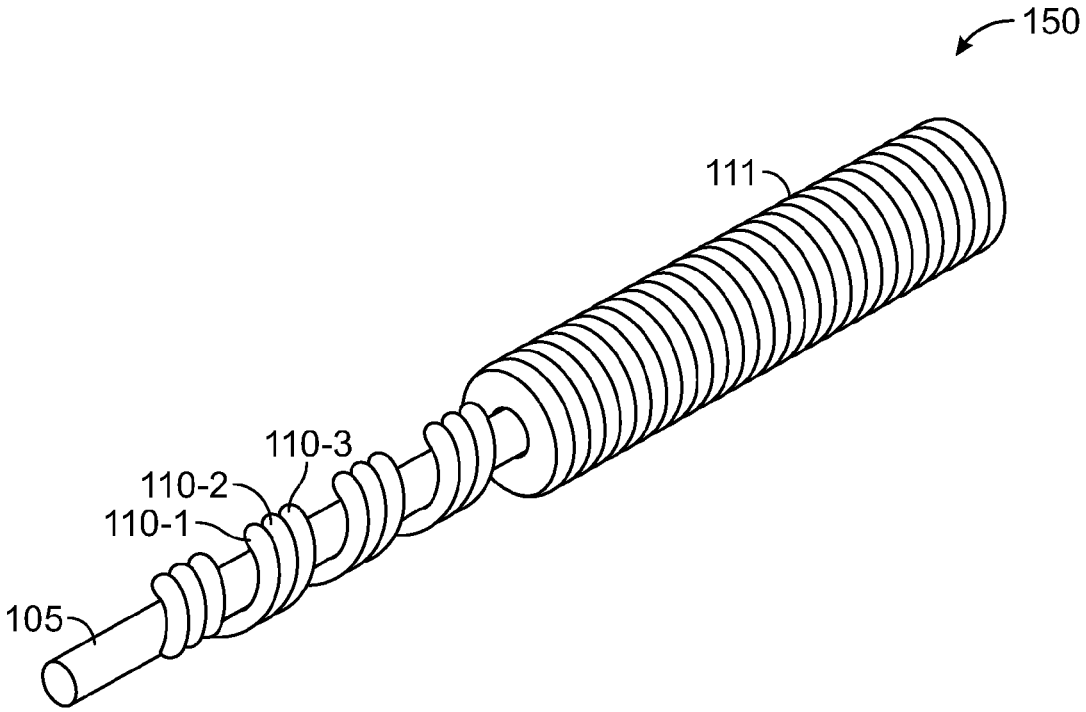
FIG. 3 is a perspective view of the cable of FIG. 2 configured with a protective layer.

FIG. 3 is a perspective view of the cable 150 configured with a layer 111. Here, the layer 111 is configured about the conductors 110 so as to provide a protective covering for the conductors 110. The layer 111, to keep the overall cable 150 elastic, is generally configured from an elastic material as well. However, the layer 111 does not necessarily need to be configured from the same polymer as the elastomeric core 105. For example, layer 111 may be configured from a material that stretches to a certain degree but then provides a substantial amount of resistance prior to breakage, thereby further assisting to limit the length of extension of the cable 150. Examples of such include reinforced rubber, cloth, and the like.

It should be noted that the invention is not intended be limited to any particular material for protecting the conductors 110 and the elastomeric core 105. It should also be noted that the invention is not intended to be limited to any particular number of conductors 110 wrapped about the elastomeric core 105 or any other number of conductors 110 illustrated herein.

Figure 4:
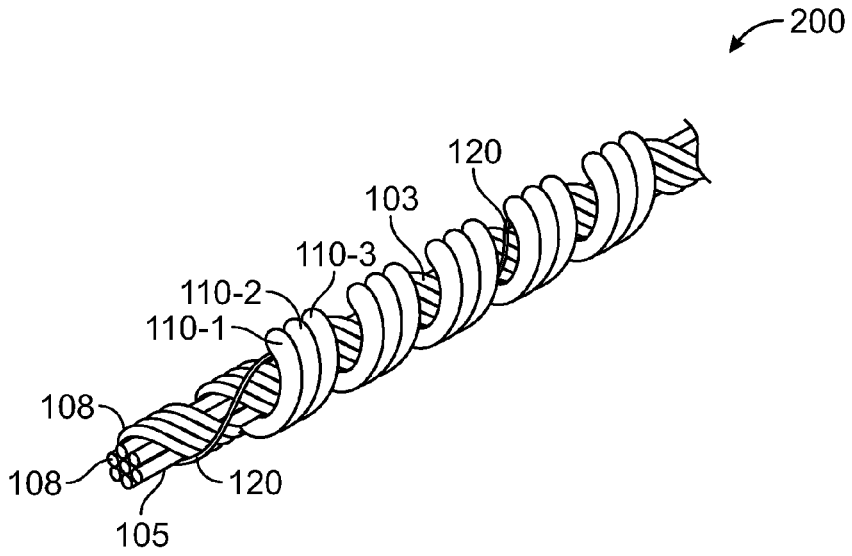
FIG. 4 is a perspective view of an exemplary elastomeric cable with conductors wrapped about a stranded elastomeric core and configured with a stay cord.

FIG. 4 is a perspective view of an exemplary elastomeric cable 200 with conductors 110 wrapped about a stranded elastomeric core 105 and configured with a stay cord 120. In this embodiment, the elastomeric core 105 is configured from a plurality of elastomeric strands 108 that are banded together. Each of the strands 108 may be configured from an elastomeric polymer as described herein. The banding of the strands 108 serves to provide elasticity to the overall cable 200 as each strand 108 is elastic. But, the combination of multiple elastomeric strands 108 also serves to provide resistance to breakage, similar to a bungee cord. The conductors 110 are then wrapped about the elastomeric core 105 in a manner similar to that described above. Assisting in the break resistance is a stay cord 120 wrapped about the elastomeric core 105 and generally under the conductors 110. The stay cord 120 ensures that the cable 200 resists breakage. For example, the stay cord 120, being wrapped about the elastomeric core 105, will extend a certain length as the core 105 is stretched in a linear fashion. If the stay cord 120 is configured from a material that is generally not stretchable, then the elastomeric core 105 can only stretch as far as the stay cord 120 can extend in the linear direction of the cable 200.

Materials that can be used to implement the stay cord 120 can vary as a matter of design choice. For example, the stay cord 120 may be configured as a relatively thin swaged cable from a plurality of wires. Alternatively, the stay cord 120 may be configured as a single malleable wire, Kevlar, nylon, or even a cotton string. Accordingly, the material used to implement the stay cord 120 may be designed based on environmental conditions with known levels of stress being exerted on the cable 200. Moreover, while illustrated with respect to the strands 108 of the core 105 being wrapped about other strands, the invention is not intended to be limited to the illustrated example. The strands 108 of the elastomeric core 105 could be configured in a variety of ways as a matter of design choice (e.g., braided, woven, knitted, etc.).

Figure 5:
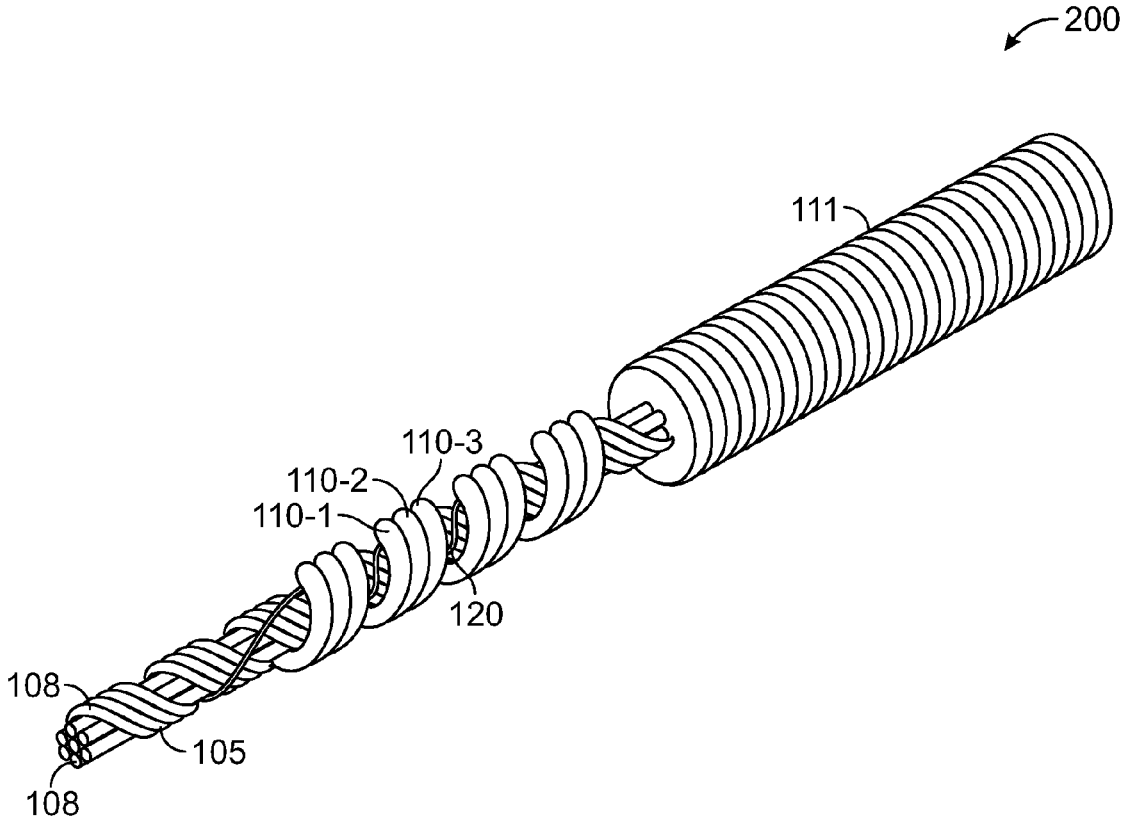
FIG. 5 is a perspective view of the cable of FIG. 4 configured with a protective layer.
Figure 6:
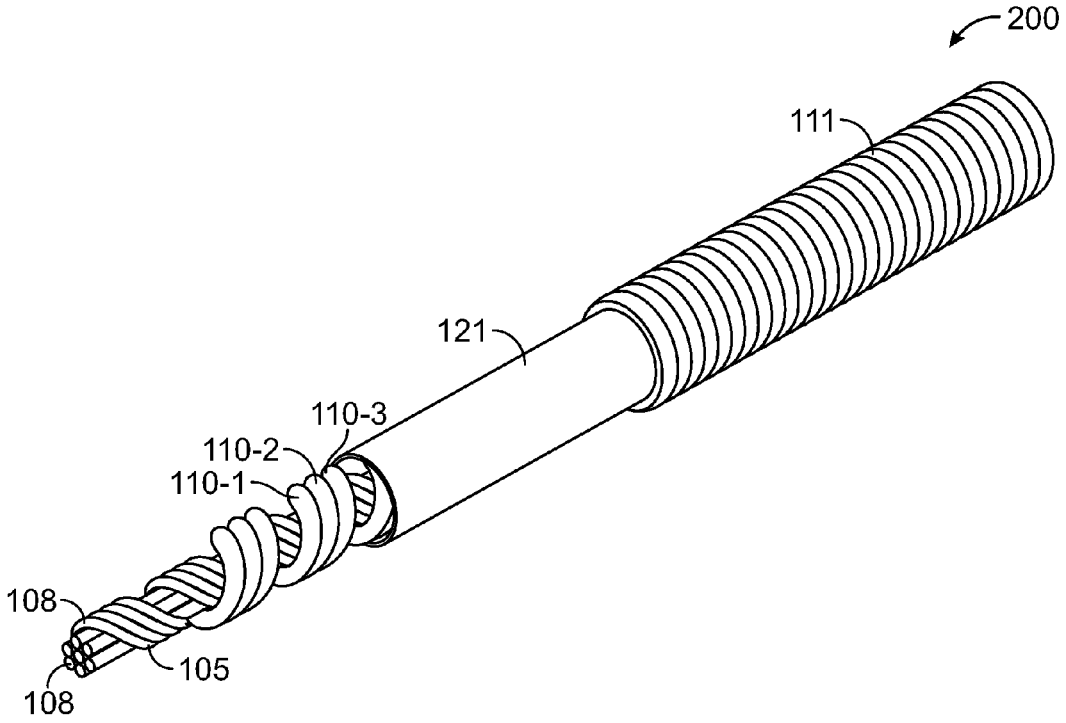
FIG. 6 is a perspective view of the cable of FIG. 4 configured with shielding and a protective layer.

FIG. 5 is a perspective view of the cable 200 of FIG. 4 configured with a protective layer 111. Again, the protective layer 111 may be configured in a variety of ways as a matter of design choice so as to protect the underlying conductors 110, elastomeric core 105, and the stay cord 120. FIG. 6 is a perspective view of the cable 200 of FIG. 4 configured with shielding 121 and the protective layer 111 overlaying the shielding 121. As mentioned above, the shielding may be implemented in a variety of ways including a doped elastomeric polymer or a metallic fabric. Although not illustrated in FIG. 6, the stay cord 120 can be configured in this embodiment as well.

Figure 7:
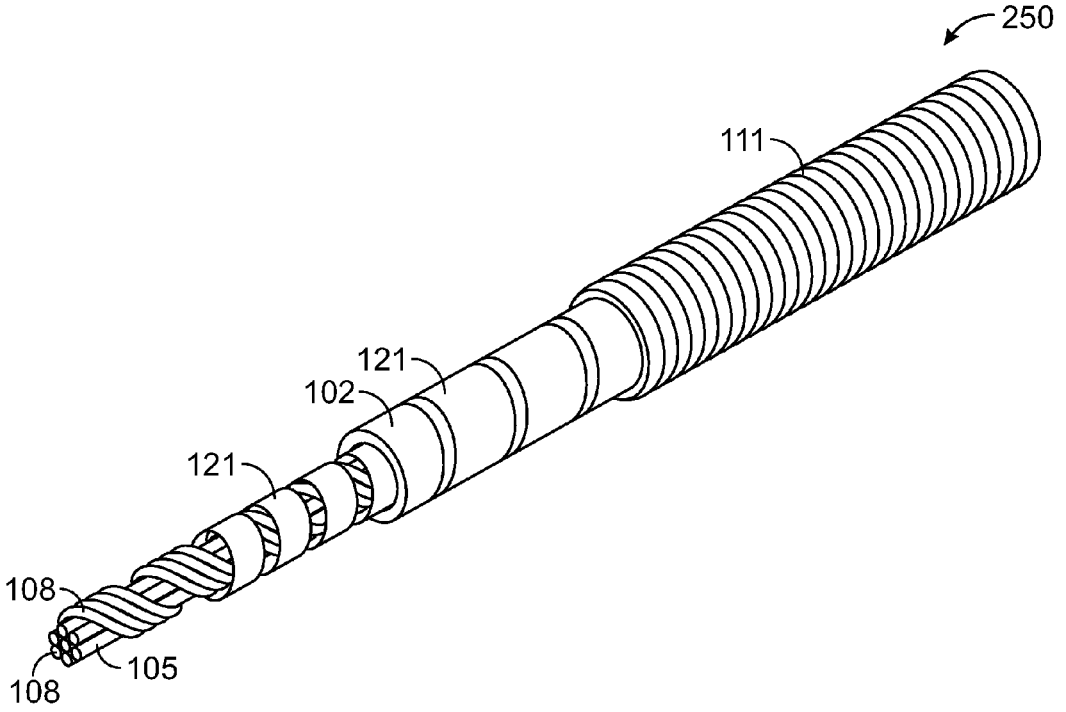
FIG. 7 is a perspective view of an exemplary elastomeric coaxial cable employing a stranded elastomeric core.

FIG. 7 is a perspective view of an exemplary elastomeric coaxial cable employing a stranded elastomeric core 105. In this embodiment, the core 105 is wrapped with a shielding 121 that still allows the cable 250 to stretch along the length of the cable 250. However, depending on the type of shielding employed, the length of that stretch may be restricted to some degree.

This shielded core is then encased in an elastomeric insulator 102. For example, the insulator 102 may be an elastomeric polymer that covers the shielded core of components 105 and 121 and is then extruded to produce an insulated shielded core. Alternatively, the shielded core of the cable 250 may be insulated via an injection molding process. In any case, the coaxial feature of the cable 250 established with another layer of shielding 121 which allows the propagation of electromagnetic waves along the cable 250. The outer shielding 121 is then covered with a protective layer 111 as described hereinabove.

Figure 8:
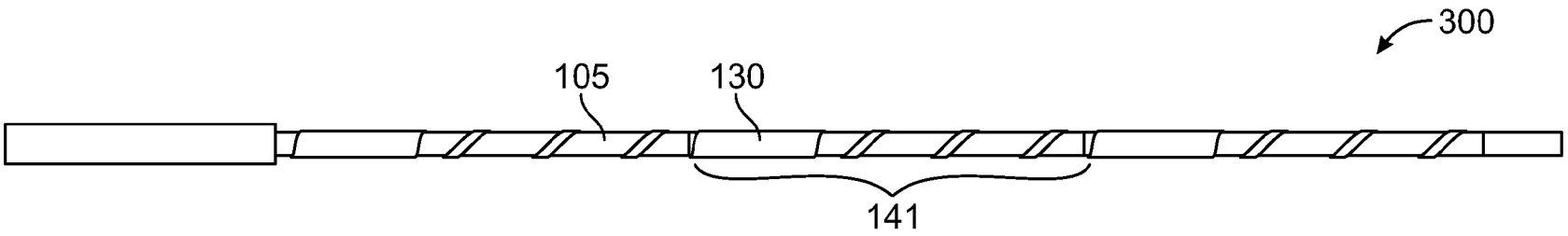
FIGS. 8 and 9 illustrate two exemplary cables configured with an elastic core and banded signal identifiers.
Figure 9:
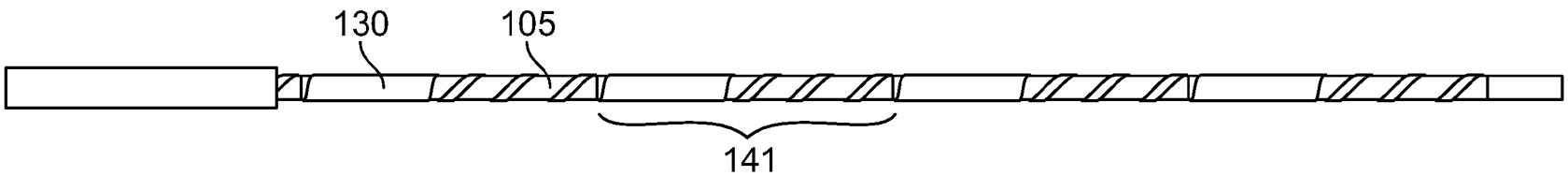

FIGS. 8 and 9 illustrate two exemplary cables 300 configured with an elastic core 105 and banded signal identifiers 130. These cables 300 provide for the rapid identification of hidden lines. To illustrate, each cable 300 is configured with a signature of sorts that allows it to be rapidly identified when hidden. Each cable 300 may be uniquely wrapped with a conductive material that is relatively elastic in nature to provide signatures 141 and 142. Such may include a conductive thread or wire that is wrapped about the cable in discrete increments. In some embodiments, such may even include nano-particulate materials that are embedded in an elastic material that allows the conductive nature of the nano-particulate material to also be elastic.

In any case, the signatures 141 and 142 may be configured by the manner in which the conductive material 130 is wrapped about the cables 300. For example, by wrapping a cable 300 in the conductive material 130 such each cable 300 has a distinct signature (141 and 142), a sensor can be configured to radiate electromagnetic energy at the cable 300 to capacitively couple with the wrappings/spacings so as to identify the signature of the cable 300.

In some instances, the signatures 141 and 142 can be assigned according to utility. For example, a sewer pipeline may be wrapped with the signature 141 while a fresh water line may be wrapped with the signature 142. Accordingly, when the sensor is placed within proximity of either of the two pipelines, the sensor is able to distinguish the two pipelines. Thus, when work is required on a freshwater pipeline, the sewer pipeline may lay undisturbed.

In some embodiments, the wrappings/spacings are extruded onto cables during the cable manufacturing process. Generally, however, the wrappings/spacings are configured by wrapping and/or braiding conductive material 130 on the cables 300. Alternatively or additionally, the cable itself may be elastic. For example, when digging using heavy equipment, cables can be snagged by the equipment and ultimately broken by the equipment. By configuring the cables to be elastic, the cables themselves may stretch when snagged by the equipment allowing them to retain their conductive/electromagnetic characteristics without being broken.

Figure 10:
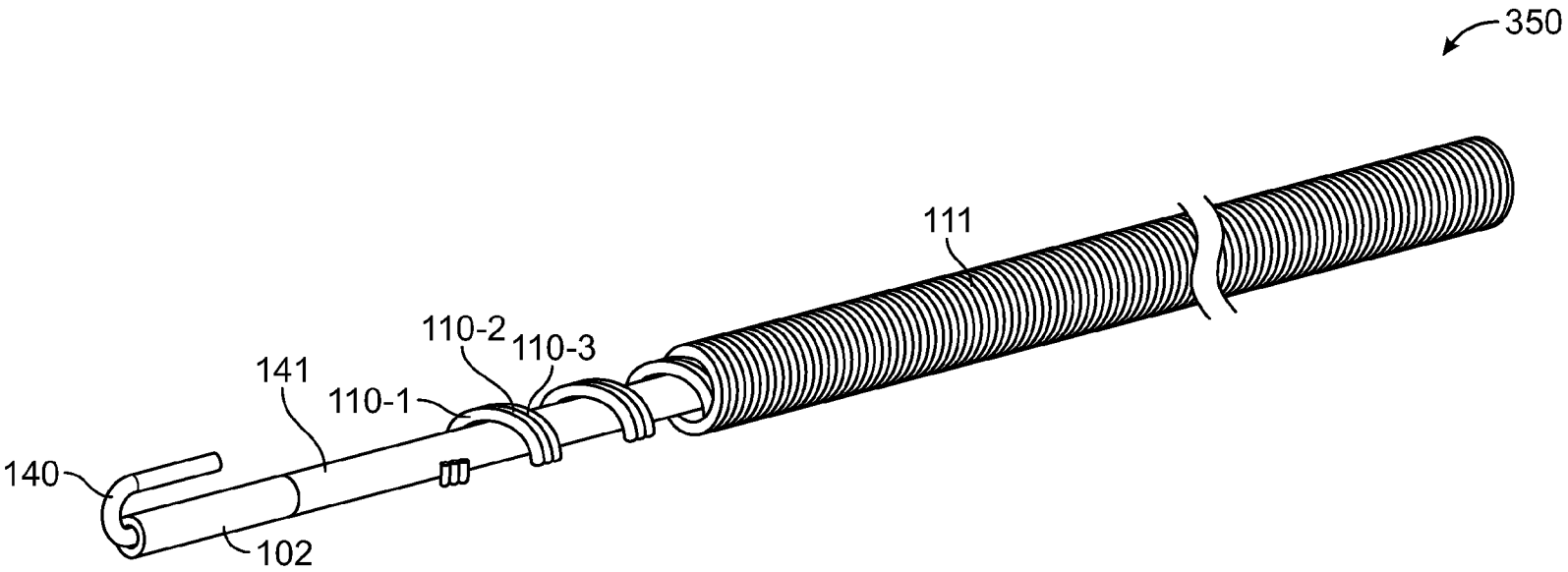
FIG. 10 is a perspective view of an exemplary flexible cable with a malleable wire extruded with an elastomeric tube.
Figure 11:
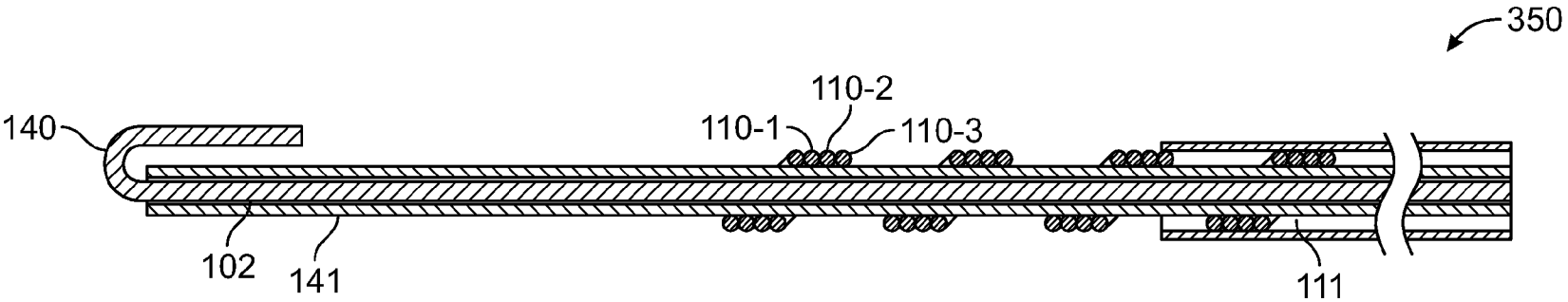
FIG. 11 is a cut-away view of the exemplary flexible cable of FIG. 10.

FIGS. 10 and 11 illustrate two views of an exemplary flexible cable 350. More particularly, FIG. 10 is a perspective view of the exemplary flexible cable 350 with a malleable forming wire 140 within an elastomeric insulator 102. And, FIG. 11 is a cut-away view of that exemplary flexible cable 350. The cable 350 is generally configured by extruding the forming wire 140 (e.g., a stainless steel wire) within an elastomeric material such as an elastomeric polymer. This allows the cable 350 to be flexible yet rigid while providing a certain level of comfort if the cable is to be worn.

For example, headphones generally require cabling to route signals to the speakers of the headphones. Newer designs of headphones even include having a user wear the headphone on the user's ear. This generally requires some sort of anchoring mechanism in or about the user's ear. The cable 350 allows the headphone to be anchored about the user's ear to comfortably position the speaker of the headphone proximate to the user's ear.

The extruded wire 140/elastomeric insulator 102 combination of the cable 350, in one embodiment, is covered with a braided Kevlar material 141 (or other suitable material such as nylon). From there, conductors 110 are then wrapped around the cable for subsequent connection to various wearable electronic devices. The overall cable 350 may then be wrapped in a flexible outer jacket material 111.

In an additional or alternative embodiment, the cable 350 is extruded as a cylinder with a notch (e.g., a concave gap) along the length of the cylinder such that forming wire can be laid inside the notch. Then, the cable is covered with a protective material. In any case, this design substantially eliminates the outer material 111 from bunching up while also decreasing the diameter.

The cables herein can be assembled in lengths as desired depending on design choice. For example, for an earpiece designed for a headphone where the cable 350 wraps around the ear as desired by the user, the cable 350 may be relatively short. In other designs where the electronics traverse longer portions of the user's body (e.g., the arm or the leg), the cables 350 may be much longer in length. Moreover, the embodiments herein and components thereof may be combined in variety of ways as a matter of design choice. Accordingly, the invention is not intended to be limited to the exemplary embodiments herein.

In one embodiment, the cable 350 is manufactured using a sacrificial guide wire. For example, the cable 350 is cut longer than a particular design requires and then it is held bare at both ends. Then, the cable 350 is stretched to reduce the size and release from the extruded components. Afterwards, the entire guide wire is extracted from the cable 350, creating the tube for adding the new forming wire 140.

The cables herein can be assembled in lengths as desired depending on design choice. For example, for an earpiece designed for a headphone where the cable 350 wraps around the ear as desired by the user, the cable 350 may be relatively short. In other designs where the electronics traverse longer portions of the user's body (e.g., the arm or the leg), the cables 350 may be much longer in length. Moreover, the embodiments herein and components thereof may be combined in variety of ways as a matter of design choice. Accordingly, the invention is not intended to be limited to the exemplary embodiments herein.

Figure 12:
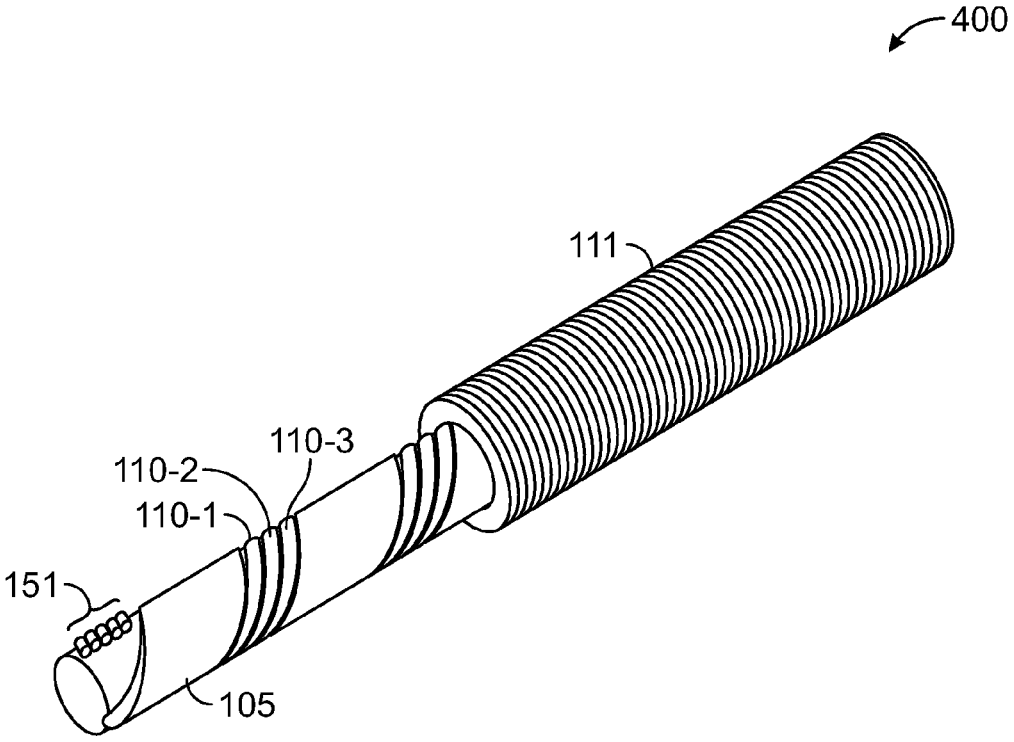
FIG. 12 is a perspective view of an exemplary elastomeric cable with conductors embedded in an elastic core.

FIG. 12 is a perspective view of an exemplary elastomeric cable 400 with conductors 110-1-110-3 embedded in an elastomeric core 105. In this embodiment, a notch 151 spirals along the length of the cable 400. The conductors 110 are configured in the spiraling notch 151 so as to reduce the bulk of the cable 400. For example, as the conductors 110 are essentially embedded in the elastomeric core 105, they are less likely to protrude. This has the effect of reducing the wear and tear on the protective cover 111 that is configured on the afterwards.

The notch 151 of the elastomeric core 105 may be configured in a variety of ways as a matter design choice. For example, once the core 105 is extruded, the notch 151 may be spirally cut into the core 105. Alternatively, the notch 151 may be implemented by spirally extruding a notch in the core 105 with a die. In any case, the core 105 is wrapped with the conductors 110 in the notch 151 thereafter.

Figure 13:
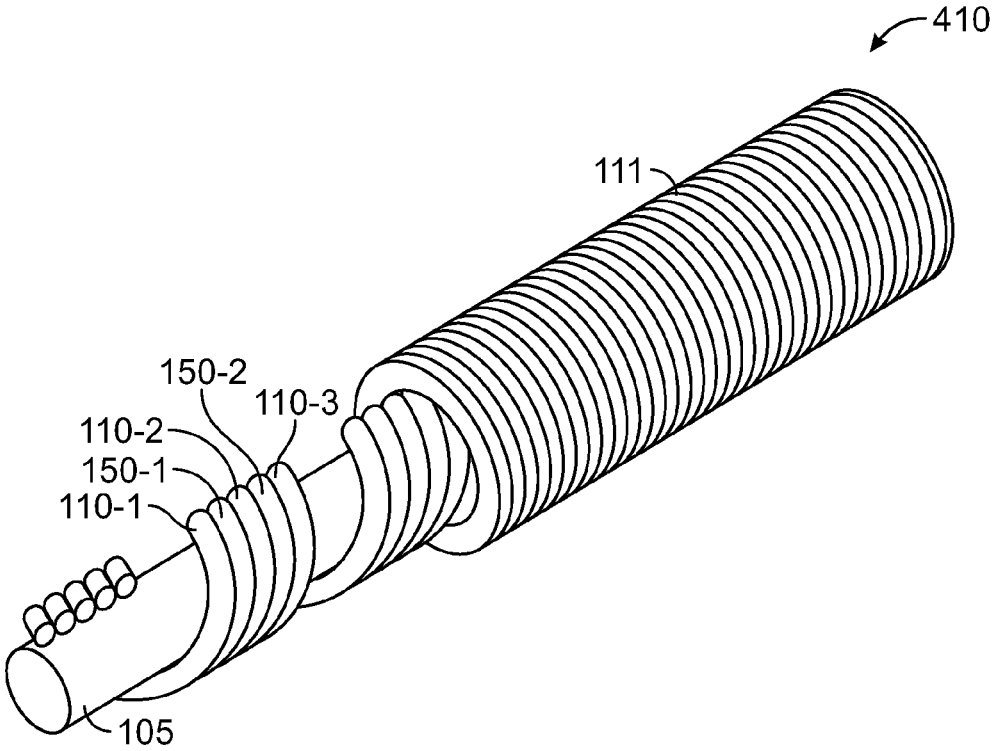
FIG. 13 is a perspective view of an exemplary elastomeric cable with conductors wrapped about an elastic core with spacers.

FIG. 13 is a perspective view of an exemplary elastomeric cable 410 with conductors 110-1-110-3 wrapped about an elastic core 105 with spacers 150-1 and 150-2. In this embodiment, the conductors 110 are again spirally wrapped as illustrated in some of the embodiments described hereinabove. Differing from those embodiments, however, are the spacers 150 that are spirally wrapped in between the conductors 110. For example, the conductor 110-1 is spirally wrapped next to the spacer 150-1 which is spirally wrapped next to the conductor 110-2. The conductor 110-2 is spirally separated from the conductor 110-3 with the spirally wrapped spacer 150-2.

The spacers 150 provide enough distance between the conductors 110 so as to prevent crosstalk among the conductors. For example, traditional data cables comprise twisted pairs of conductors. The twisting of those conductors tends to negate crosstalk among the conductors through cancellation. The spacing in this embodiment also tends to negate crosstalk among the conductors but does so by creating a distance between the conductors that overcomes the crosstalk as opposed to the cancellation among the traditional data cables. This is possible because the distance is operable to overcome the electromagnetic radiation of the cables, which is typically on the order of a few picofarads. The elastomeric core 105 enables a fully capable data cable with the additional advantage of being "stretchy".

Figure 14:
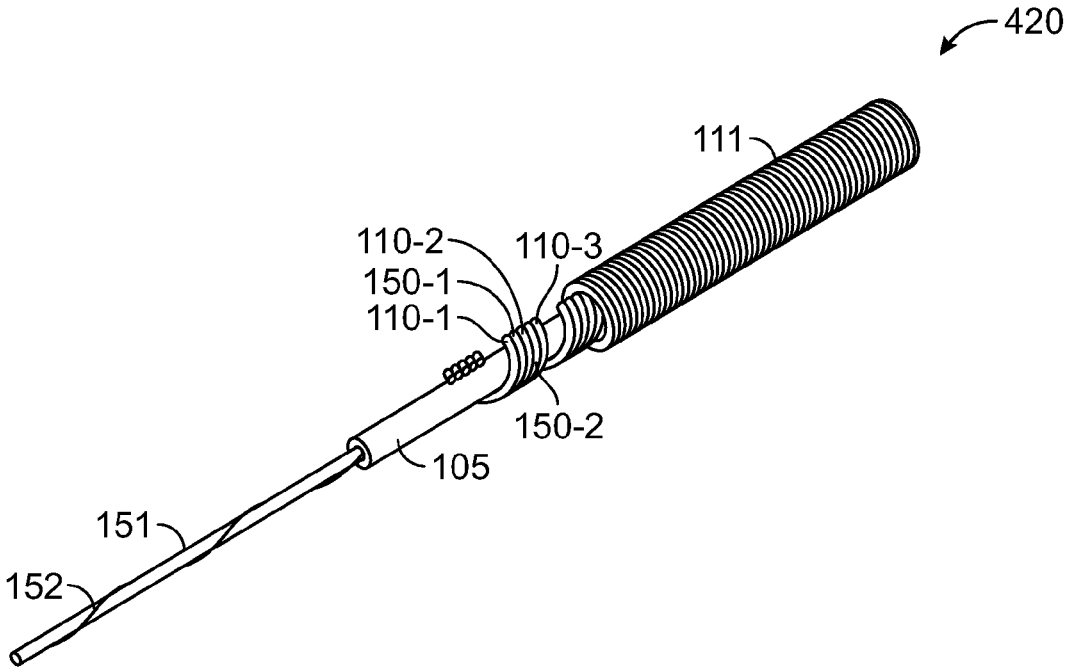
FIGS. 14 and 15 are perspective views of an exemplary cable comprising an elastomeric core and conductors configured about a strengthening member.

FIG. 14 is a perspective view of an exemplary cable 420 comprising an elastomeric core 105 and conductors 110 configured with a strengthening member 152. In this embodiment, the spacers 150 again provide the distance between the conductors to overcome crosstalk. The strengthening member 152 is operable to allow the cable 420 to stretch and contract along the length of the cable while providing a certain limit to that stretch length. For example, when the cable 420 is pulled at some point along its length, the elastomeric core 105 will allow the cable 42 to stretch. However, the strengthening member 152 limits that amount of stretch so that the cable does not break.

Figure 15:
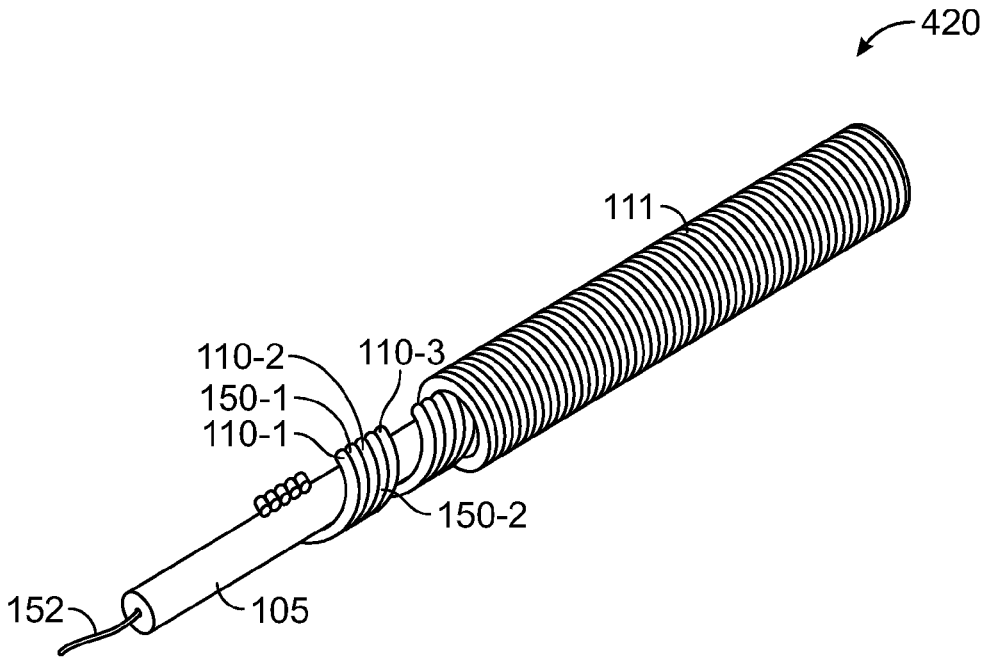

FIG. 14 illustrates how the strengthening member is implemented with the cable 420 by means of a solid core stylet. For example, as with the embodiments described hereinabove, the elastomeric core 105 may be extruded as a tube. The strengthening member 152 may be wrapped about a solid metal core 151. The combined metal core 151 and strengthening member 152 may then be extruded with the elastomeric core 105 to embed the strengthening member 152 within the cable 420. Afterwards, the solid metal core 151 is removed leaving the strengthening member 152 within the cable, as illustrated in FIG. 15.

The strengthening member 152 may be implemented in a variety ways as a matter design choice. For example, operating in a fashion similar to the stay cords described hereinabove, the strengthening member 152 may be configured from Kevlar or some other strengthening material to provide break resistance to the cable 420.

Figure 16:
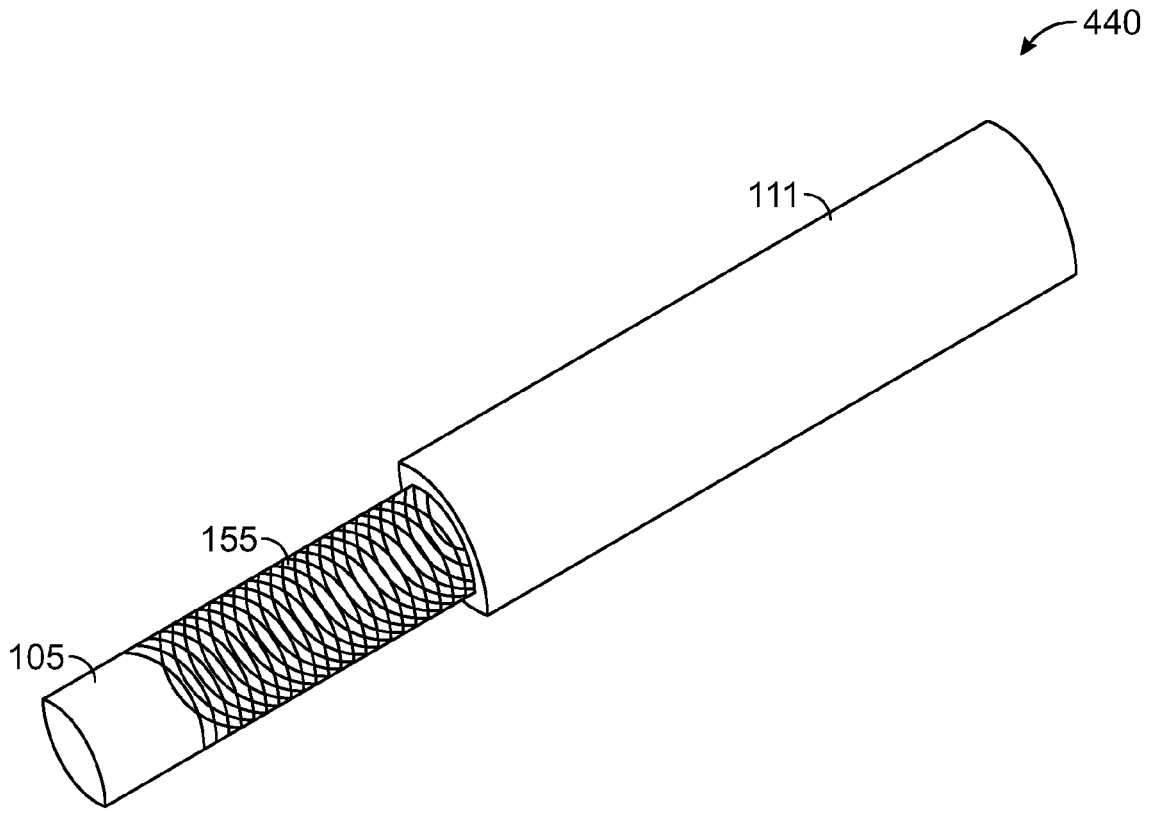
FIG. 16 is a perspective view of an exemplary cable configured as an antenna.

FIG. 16 is a perspective view of an exemplary cable 440 configured as an antenna. In this embodiment, the elastomeric core 105 is braided or otherwise covered with a metallic fabric 155 or other conductive material. The cable 440 is then covered with a protective layer 111 as described above. The metallic fabric 155 may comprise a relatively high "strand count" that provides the necessary skin effect to increase the antenna effectiveness. The elastomeric core 105 provides the elasticity to allow the antenna to stretch.

This embodiment may be particularly useful in the wearable electronics industry. For example, radios may be worn on or configured with clothing. This stretchable antenna may also be configured with the clothing and coupled to a radio such that the radio may receive signals. The elastomeric core 105 allows the wearer to move more freely than having a rigid antenna affixed to the clothing.

This embodiment has other advantages as it may be useful in assisting with line detection. For example, cellular providers maintain cell towers with antennas. Those antennas are connected cables that are often buried underground. To identify the cables, they are typically configured with "tracers" that are energized. Lightning strikes to the cell tower antennas tend to burn the portions of the tracer lines that are above ground (e.g., due too much current flow from the lightning strike). Once this happens, tracer lines can no longer be energized to identify a buried antenna cable. This embodiment allows for rapid repair the tracer line via the connection of another portion of the cable to replace the burned portion. Then, the tracer line can be energized to identify its associated cable.

Exemplary design configurations and methods of manufacture are shown and described in the following drawings. It should be noted however that the figures and the description herein illustrate specific exemplary embodiments of the invention. It will thus be appreciated that those skilled in the art will be able to devise various arrangements that, although not explicitly described or shown herein, embody the principles of the invention and are included within the scope of the invention. Furthermore, any examples described herein are intended to aid in understanding the principles of the invention and are to be construed as being without limitation to such specifically recited examples and conditions. As a result, the invention is not limited to the specific embodiments or examples described below.

What is claimed is:

1. A cable, comprising:

an insulator extruded as a tube;

a flexible metal wire extruded with the insulator through a conduit of the tube;

at least two conductors wrapped about an external surface of the insulator along a length of the cable so as to separate the conductors from the flexible metal wire; and a material layer surrounding the insulator along the length of the cable.

2. The cable of claim 1, wherein:

the insulator comprises a polymer.

3. The cable of claim 1, wherein:

the flexible metal wire is aluminum.

4. The cable of claim 1, wherein:

the flexible metal wire is copper.

5. The cable of claim 1, wherein:

the flexible metal wire is stainless steel.

6. The cable of claim 1, wherein:

the at least two conductors are each insulated.

7. The cable of claim 1, further comprising:

a metallic shielding configured over the at least two conductors and under the second insulator.

8. The cable of claim 1, wherein:

the material layer comprises Kevlar or nylon.

9. A cable, comprising:

an elastomeric insulator extruded as a tube; and an elastomeric conductor comprising conductive particles embedded in a polymer, wherein the elastomeric conductor is extruded with the elastomeric insulator through a conduit of the tube.

10. The cable of claim 9, further comprising:

an elastomeric shielding extruded with the elastomeric insulator and the elastomeric conductor, wherein the elastomeric insulator separates the elastomeric conductor from the elastomeric shielding.

11. The cable of claim 10, wherein:

the elastomeric shielding comprises conductive particles embedded in a polymer.

12. The cable of claim 10, wherein:

the elastomeric shielding comprises a metal fabric.

13. The cable of claim 9, wherein:

the elastomeric insulator and the elastomeric conductor are extruded together from the same polymer of the elastomeric conductor;

the conductive particles of the elastomeric conductor comprise carbon nanotubes doped in the polymer of the elastomeric conductor; and the polymer of the elastomeric insulator is not doped with conductive particles.

14. The cable of claim 9, further comprising:

a stay cord configured alongside the elastomeric insulator and the elastomeric conductor, wherein the stay cord is operable to limit extension along a length of the cable.

15. A cable, comprising:

an elastomeric core;

at least two insulated conductors configured about an external surface of the elastomeric core along a length of the cable, wherein the at least two insulated conductors are separated from each other along the length of the cable and wherein said separation of the at least two insulated conductors is operable to reduce crosstalk in the cable;

a stay cord configured alongside the elastomeric core, wherein the stay cord is operable to limit extension along the length of the cable; and an elastomeric insulator configured about the elastomeric core and covering the at least two insulated conductors and the stay cord.

16. An elastomeric antenna, comprising:

an elastomeric core;

a conductive material applied to an exterior surface of the elastomeric core, wherein the conductive material is operable to stretch along a length of the elastomeric core while maintaining conductivity throughout the length of the antenna; and a connector operable to couple the antenna to a radio transceiver, wherein the conductive material is a braided metal fabric.

17. An elastomeric antenna, comprising:

an elastomeric core;

a conductive material applied to an exterior surface of the elastomeric core, wherein the conductive material is operable to stretch along a length of the elastomeric core while maintaining conductivity throughout the length of the antenna; and a connector operable to couple the antenna to a radio transceiver, wherein the conductive material is a conductive particulate embedded in an elastic material that surrounds the elastomeric core.

* * * * *